United States Patent [19]

Luitz et al.

[11] Patent Number: 4,522,424

[45] Date of Patent: Jun. 11, 1985

[54] SKI BINDING CLAMP

[75] Inventors: Max Luitz, Blaichach-Bihlerdorf; Eugen Weiss, Burgberg, both of Fed. Rep. of Germany

[73] Assignee: ESS GmbH Skibindungen, Immenstadt, Fed. Rep. of Germany

[21] Appl. No.: 457,743

[22] Filed: Jan. 14, 1983

[30] Foreign Application Priority Data

Jan. 18, 1982 [DE] Fed. Rep. of Germany ..... 3201319

[51] Int. Cl.[3] ..... A63C 9/00

[52] U.S. Cl. ..... 280/633; 24/68 SK

[58] Field of Search ..... 280/633, 634; 24/68 A, 24/68 SK, 70 T, 70 SK

[56] References Cited

U.S. PATENT DOCUMENTS

| | | | |
|---|---|---|---|
| 357,287 | 2/1887 | Nolte | 24/68 SK |
| 963,052 | 7/1910 | Lemak | 24/68 B |
| 3,807,748 | 4/1974 | Ramillon | 280/633 |
| 3,913,931 | 10/1975 | Kratky | 280/633 X |
| 4,157,193 | 6/1979 | Beyl | 280/633 |

FOREIGN PATENT DOCUMENTS

| | | | |
|---|---|---|---|
| 276180 | 11/1969 | Austria | 280/633 |
| 1954512 | 5/1970 | Fed. Rep. of Germany . | |
| 2250615 | 5/1973 | Fed. Rep. of Germany . | |
| 2541471 | 6/1976 | Fed. Rep. of Germany . | |
| 3015478 | 11/1980 | Fed. Rep. of Germany | 280/633 |
| 2368974 | 5/1978 | France . | |

*Primary Examiner*—Joseph F. Peters, Jr.
*Assistant Examiner*—Michael Mar
*Attorney, Agent, or Firm*—Ratner & Prestia

[57] ABSTRACT

The ski binding clamp mechanism includes a base plate 5 which is to be attached to a ski 1, as well as a clamping unit 7 which is guided in lengthwise displaceable manner along the ski. A locking arrangement 15 latches the clamping unit 7 to the base plate 5 in predetermined displacement positions. The locking arrangement 15 has a locking member 21 movably attached to the clamping unit 7 and is held by a spring 17 in mating engagement with a complementary locking member 23 of base plate 5. A double arm lever 27, pivotally attached to the clamping unit 7 and having an operating arm 33 and a disengaging arm 35, disengages the locking arrangement 15 against the resistance of spring 17. The disengaging arm 35 is substantially shorter than the operating arm 33 in order to facilitate the disengaging action. A locking projection 41 prevents undesired disengagement of the locking arrangement 15 when lever 27 is latched in the operating position of the ski binding clamping mechanism. When the locking arrangement 15 is disengaged, the locking projection 41 prevents the lever from being moved back into its rest position.

8 Claims, 4 Drawing Figures

SKI BINDING CLAMP

The invention relates to a ski binding clamp mechanism, and particularly to toe clamps having a base plate adapted to be attached to the ski, a clamping unit which is guided displaceably along the base plate lengthwise of the ski, and a locking arrangement which latches the clamping unit to the base plate in predetermined displacement positions. The locking member of this locking arrangement which is movably attached to the clamping unit is maintained by a spring in mating engagement with a complementary locking member of the base plate.

Ski binding clamps which are displaceable lengthwise of the ski, and which may be either toe clamps or heel clamps, enable the adjustment of the ski binding to the size of the ski boot or, when both toe clamps and heel clamps are adjustable, the adjustment of the ski binding position relative to the ski.

In ski binding clamps of the initially described type, high operating forces are required for disengaging the locking arrangement in order to prevent unintended release. The operating members of the locking arrangement, on the other hand, are relatively small for safety reasons and are mounted so as to be hard to reach, which makes their manipulation difficult.

Accordingly, it is an object of the present invention to provide a technique which facilitates the manipulation of longitudinally adjustable ski binding clamps.

This object is achieved in accordance with the invention by pivotally attaching to the clamping unit a double arm lever, which has an operating arm and a movable disengaging arm which is shorter than the operating arm, and which acts against the pretensioned force of the spring in a direction to disengage the locking member of the clamping unit, or alternatively a member which is rigidly attached to this locking member. The mechanical advantage which results from the different arm lengths facilitates the disengagement of the locking arrangement and with it the displacement of the ski binding clamp. When the disengagement device is engaged, the disengaging arm is lifted away from the locking member of the clamping unit. When the operating arm is displaced away from its normally latched rest position, this modified arm position is usually discernable even before the disengaging arm acts upon the locking arrangement.

In a preferred embodiment, the lever has a locking projection upon that side of its pivot axis which is opposite to the disengaging arm. This locking projection bears against that locking member, or against a member which is rigidly attached thereto, when the locking member of the clamping unit is disengaged, while restricting the lever displacement angle which is possible when the locking member is engaged. In this embodiment, the operating arm can be swung into its rest position only when the locking arrangement is fully engaged.

The locking projection can further perform a self-restraining locking function, when it is provided with a locking surface which is elastically engageable with the locking member, or with a member which is rigidly attached thereto, when the locking member is engaged. In its engaged condition, this locking surface extends into the disengaging path of the locking member, or of the member which is rigidly attached thereto. By means of such a locking surface, the lever can be latched in the rest position. At the same time, the locking projection prevents disengagement of the locking member of the clamping unit from the complementary locking member of the base plate.

In a structurally simple embodiment the locking member of the clamping unit is provided with a leaf spring which extends generally parallel to the base plate, is held at one end by the clamping unit, and is provided with at least one locking projection, while its free end extends into the pivot path of the disengaging arm. The leaf spring is pretensioned toward the base plate and preferably has, as its locking projection, a pin which extends toward the base plate.

Preferably, the lever is mounted at the end of the clamping unit remote from the boot, pivotably attached to the clamping unit by a hinge pin which may be parallel to the base plate but transverse to the displacement direction. The operating arm extends over the top of the clamping unit, in its rest position, when the locking arrangement is engaged. In this embodiment the operating arm can be swung through nearly 180° between its rest position and that position in which the locking arrangement is kept disengaged. This wide displacement range improves the protection against unintentional release of the locking arrangement. A further advantage of this embodiment applies particularly to toe clamps of ski bindings, because here the operating arm closes against the direction of travel. In this embodiment, the operating arm can cover almost the entire length of the ski binding clamp, so that relatively large displacement excursions of the lever are achieved.

A further substantial improvement is obtained by shaping the operating arm as a cap-like cover, which at least partially encloses the clamping unit in its rest position. This cover provides smooth, projection-free outer surfaces and protects the safety mechanism of the ski binding clamp, including its adjustment means. At least on its exterior, the cover can be made of elastic plastic, or it may be padded with plastic to reduce the risk of injury.

In what follows, an illustrative embodiment of the invention is further described with reference to the drawings in which.

Figure 1:
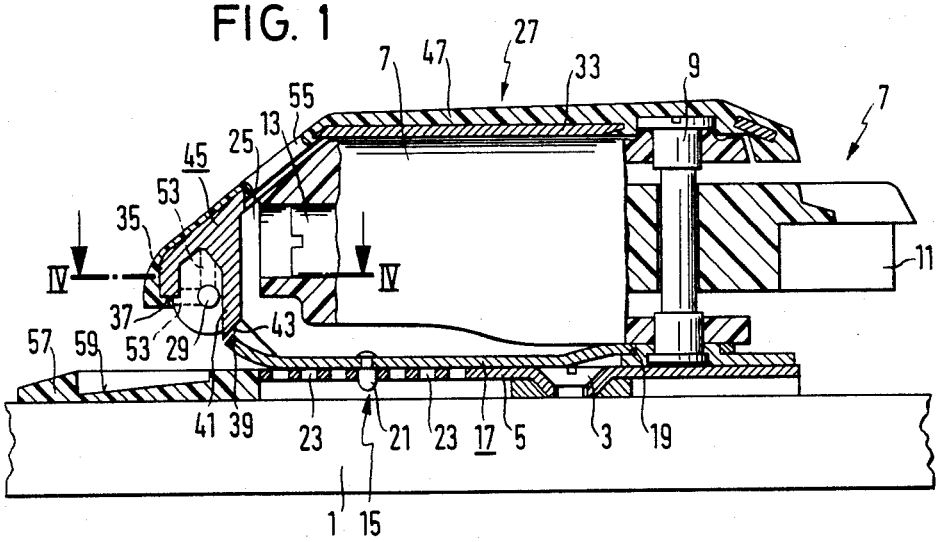
FIG. 1 shows a longitudinal cross-section through a safety toe clamp of a ski binding, which is adjustable lengthwise of the ski, and is in its locked state.

FIG. 1 shows a toe clamp for a ski binding having a base plate 5 which is attached by screws 3 to a ski 1. A clamping unit 7, displaceable longitudinally along the ski, is movable within guide means which is not illustrated in detail. The clamping unit 7 includes a sole holder 11, which is pivotable about a hinge pin 9 perpendicular to ski 1, when a release impedance is exceeded. The release impedance is adjustable by an adjustment screw 13.

To stop the clamping unit along the base plate 5 affixed to the ski, there is provided a locking arrangement generally designated by reference numeral 15. The locking arrangement has a leaf spring 17, which extends lengthwise of the ski and is generally parallel to base plate 5. End 19 of the leaf spring nearest the sole holder 11 encircles the hinge pin 9 and is attached by the latter to clamping unit 7. At a distance from end 19, the leaf spring 17 supports a pin 21 which extends toward base plate 5 and which is capable of matingly penetrating into one of several engagement holes 23 of the base plate 5, which are positioned one behind the other, spaced apart lengthwise along the ski. The leaf spring 17 is pretensioned toward the base plate 5 and holds the pin 21 in engagement with the locking hole 23 by means of its resilient force.

At that end of clamping unit 7 which faces away from the sole holder 11, along the ski, a cover 27 is pivotably attached to fork-like flanges of unit 7 by means of hinge pin 29 which extends parallel to base plate 5 and at right angles to the lengthwise direction of the ski. In its rest position shown in FIG. 1, the cover 27 extends over the top of the clamping unit 7. It extends over substantially the entire length of the clamping unit 7, and its sidewalls 31 (FIG. 2) extend lengthwise of the ski and along the sides of the clamping unit, which they thereby protect. Relative to the hinge pin 29 the cover 27 forms a double arm lever with a longer operating arm 33 and a disengaging arm 35 which is short compared with the operating arm 33. The free end of this disengaging arm 35 bears against the free end 39 of leaf spring 17 in a manner visible in FIG. 2, and raises this leaf spring 17, against the spring force, up and away from base plate 5. This lifting causes the pin 21 to be lifted out of the corresponding locking hole 23, so that the clamping unit 7 can be displaced lengthwise of the base plate 5.

Figure 2:
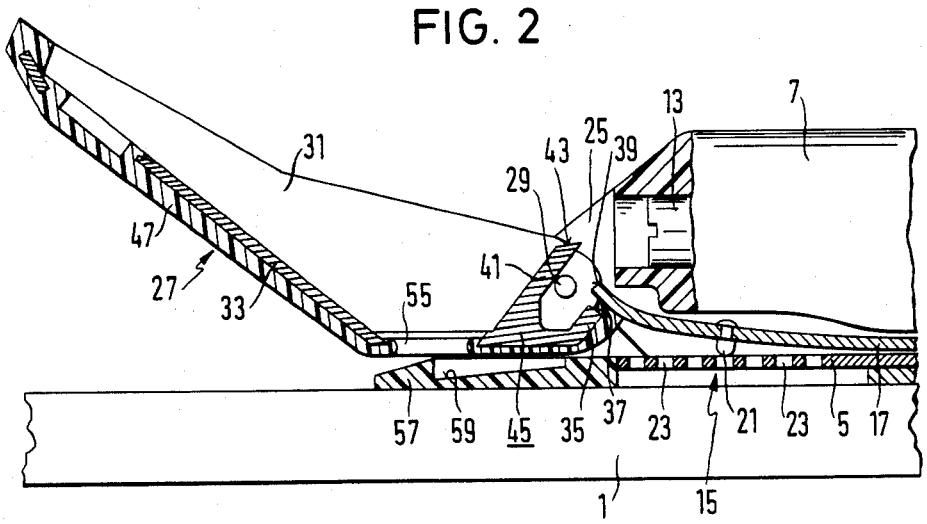
FIG. 2 shows a longitudinal cross-section through the toe clamp of FIG. 1 with the locking arrangement disengaged.

FIG. 2 further shows that the free path through which the cover 27 must be swung before the clamping arrangement becomes disengaged is relatively long and amounts to nearly 180°. The protection from unintended disengagement of the locking arrangement 15 is therefore relatively high, particularly since the lever 27 must not only be swung forward against the direction of travel, but, in the final stage of its swinging movement must also be pressed down against ski 1.

In the operating state of the toe clamp which is shown in FIG. 1, the cover 27 is in its rest position, in which it is engaged with clamping unit 7 to preclude unintended opening movement. On the side of hinge pin 29 which faces away from disengaging arm 35, the cover 27 has a locking projection 41 whose end surface 43 is so shaped that it extends into the disengagement path of the end 39 of leaf spring 17, in the rest position of cover 27. Thereby, the surface 43 of cover 27, which is latched to the clamping unit 7 in a manner hereafter further explained with reference to FIG. 4, prevents the raising up of leaf spring 17 away from the base plate 5, and with it the unlocking of locking arrangement 15. In addition but not necessarily, the surface 43 is so inclined relative to its displacement path that it extends in a self restraining manner behind the end of leaf spring 17. The surface 43 is moved into this rearward position against the elastic resistance of end 39. For this purpose, the end 39 of leaf spring 17 is curved away from base plate 5 in bowed configuration.

Figure 3:
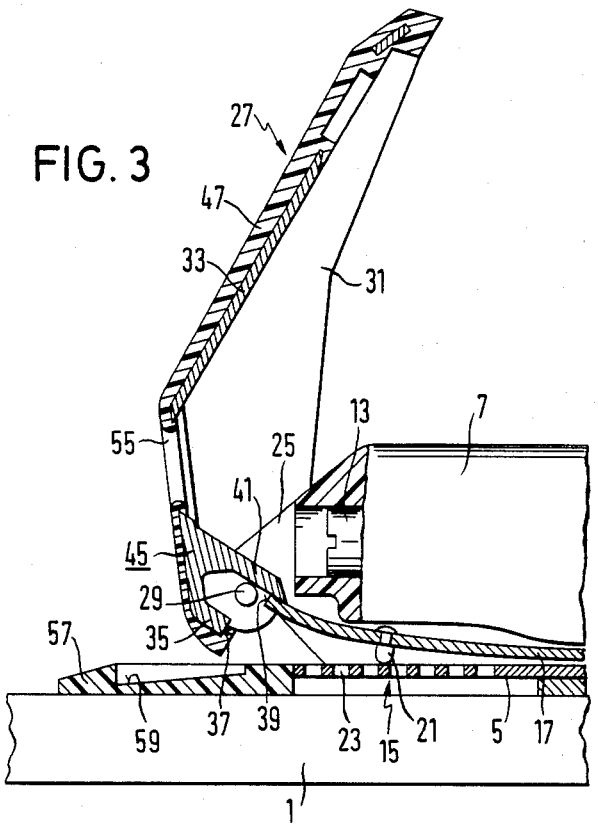
FIG. 3 shows a longitudinal cross-section through the toe clamp of FIG. 1 when the locking arrangement is not engaged.

FIG. 3 shows the clamping unit 7 in a position relative to base plate 5 in which the pin 21 mates with none of the locking holes 23, so that the locking arrangement cannot engage. To prevent closing of the cover 27 in this condition and thereby make the non-engaged state of the locking arrangement 15 visually discernable, the movement paths of locking projection 41 and of the free end 39 of leaf spring 17 are so coordinated that these two members cannot be displaced past each other when the locking arrangement 15 is not engaged. The free end 39 bears against the surface of locking projection 41 facing pivot shaft 29 before cover 27 reaches its rest position and thereby reduces the possible pivot angle of cover 27.

The cover 27 consists of a metallic base member 45, which provides the mechanical strength and of a plastic cladding 47 on its exterior. The plastic cladding 47 provides smooth external surfaces and reduces the risk of injury, particularly when foamed plastic is used.

Figure 4:
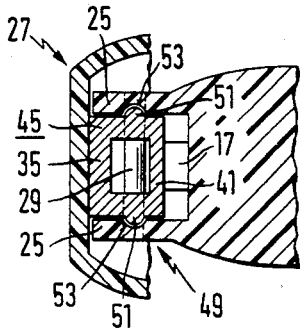
FIG. 4 shows a cross-section along the line IV—IV in FIG. 1.

FIG. 4 shows details of a latching arrangement 49 which latches the cover 27 in two different positions. The latching arrangement 49, which can take any desired form in itself, includes in the embodiment illustrated two ribs 51, which extend away from each other in the direction of pin 29 and are radial with respect to that pin upon the metallic base member 45 of cover 27, as well as corresponding grooves 53 on the confronting interior surfaces of flanges 25. The flanges 25 which are made of plastic provide elastic engagement forces.

Two grooves 53 (FIG. 1) are associated with each rib 51. One groove latches the cover 27 in the rest position, while the other groove latches the cover 27 in an intermediate position, in which adjusting screw 13 is axially accessible through a hole 55 provided in cover 27. During adjustment of the release impedance of the safety clamp, the cover 27 need not be held by hand, while the adjusting screw 13 is turned by means of a screwdriver or the like inserted through hole 55. FIGS. 1 through 3 show another detail which can also be used for further ski binding clamps. Frequently, skiers, waiting in lines for ski lifts, are closely crowded together. It then frequently happens that ski poles which are placed next to the skiers on the ground are hemmed in by other skiers, who then run over the discs of the ski poles. Skis can also be damaged when the points of the poles are placed upon unprotected ski surfaces. These problems are eliminated by a plate 57, which is attached to the side of the toe clamp farthest from the boot, and which has a recess 59 on its upper side into which the ski pole tips can be inserted. The plate 57 can be fixedly attached to base plate 5; however it can also be separately attached to ski 1. In the embodiment illustrated, the recess 59 is so arranged that it is accessible in every possible adjustment position of clamping unit 7.

We claim:

1. A ski binding clamp, particularly a toe clamp, having a base plate for attachment to a ski, a clamping unit guided along the base plate and displaceable lengthwise of the ski, and a movable locking arrangement for the clamping unit which can be locked to the base plate in predetermined displacement positions and which has a first locking member which is movably attached to the clamping unit and held by a spring in mating engagement with a second complementary locking member of the base plate, said ski binding clamp being characterized in that a double arm lever is pivotally attached to the clamping unit by means of a hinge pin, said lever having an operating arm and a disengaging arm which is shorter than the operating arm and which can be pivoted against the pretensioned force of the spring for disengaging the first locking member from the second locking member, and further characterized in that the lever has a locking projection on the side of its hinge pin which is opposite that of the disengaging arm, said locking projection bearing against said locking arrangement when said first locking member is disengaged, thereby reducing the displacement angle of which the lever is capable when said first locking member is engaged.

2. Ski binding clamp according to claim 1 characterized in that the locking projection has a locking surface which is elastically engageable with the locking arrangement when said first locking member is engaged and which, when so engaged, projects into the movement path of the locking arrangement.

3. A ski binding clamp, particularly a toe clamp, having a base for attachment to a ski, a clamping unit guided along the base plate and displaceable lengthwise of the ski, and a locking arrangement for the clamping unit which can be locked to the base plate in predetermined displacement positions and which has a first locking member which is movably attached to the clamping unit and held by a spring in mating engagement with a second complementary locking member of the base plate, said ski binding clamp being characterized in that a double arm lever is pivotally attached to the clamping unit, said lever having an operating arm and a disengaging arm which is shorter than the operating arm and which can be pivoted against the pretensioned force of the spring for disengaging the first locking member from the second locking member, and further characterized in that the base plate extends in every adjustment position beyond the end of the clamping unit remote from the sole, and in that the portion which so extends has a recess in its top surface.

4. A ski binding clamp, particularly a toe clamp, having a base plate for attachment to a ski, a clamping unit guided along the base plate and displaceable lengthwise of the ski, a release impedance adjusting means, and a locking arrangement for the clamping unit which can be locked to the base plate in predetermined displacement positions and which has a first locking member which is movably attached to the clamping unit and held by a spring in mating engagement with a second complementary locking member of the base plate, said ski binding clamp being characterized in that a double arm lever is pivotally attached to the clamping unit, said lever having (a) an operating arm in the shape of a cap-like cover which at least partially encloses the clamping unit and the release impedance adjusting means when the first locking member is in mating engagement with the second locking member and (b) a disengaging arm which is shorter than the operating arm and which can be pivoted against the pretensioned force of the spring for disengaging the first locking member from the second locking member.

5. Ski binding clamp according to claim 4 characterized in that said spring is a leaf spring which extends generally parallel to the base plate, is attached at one end to the clamping unit and has at least one locking pin, the free end of said spring projecting into the pivot path of the disengaging arm.

6. Ski binding clamp according to claim 4 characterized in that the lever is pivotably attached to the clamping unit at the end of the clamping unit remote from the boot by a hinge pin, said hinge pin being generally parallel to the base plate and at right angles to the displacement direction.

7. Ski binding according to claim 6 characterized in that the length of the operating arm is nearly equal to the length of the clamping unit.

8. Ski binding clamp according to claim 4 characterized in that the cover consists, at least on its outer surface, of elastic plastic.

* * * * *